US008640422B2

(12) United States Patent
Vandehey

(10) Patent No.: US 8,640,422 B2
(45) Date of Patent: Feb. 4, 2014

(54) METHOD OF CONSTRUCTING A MASONRY WALL

(71) Applicant: SR Contractors, LLC, Portland, OR (US)

(72) Inventor: Ronald G. Vandehey, Aloha, OR (US)

(73) Assignee: SR Contractors, LLC, Portland, OR (US)

( * ) Notice: Subject to any disclaimer, the term of this patent is extended or adjusted under 35 U.S.C. 154(b) by 0 days.

(21) Appl. No.: 13/647,240

(22) Filed: Oct. 8, 2012

(65) Prior Publication Data

US 2013/0086867 A1 Apr. 11, 2013

Related U.S. Application Data

(60) Provisional application No. 61/545,970, filed on Oct. 11, 2011.

(51) Int. Cl.
*E04B 1/00* (2006.01)

(52) U.S. Cl.
USPC ..... 52/742.13; 52/747.12; 52/749.13; 52/405.1; 52/415

(58) Field of Classification Search
USPC ..... 52/742.1, 742.13, 742.16, 747.1, 52/749.13, 749.14, 749.15, 405.1, 407.1, 52/411, 309.5, 309.11, 378, 379, 380, 381, 52/383, 415, 419, 424, 425, 428, 604, 508, 52/513, 747.12
See application file for complete search history.

(56) References Cited

U.S. PATENT DOCUMENTS 1,989,141 A * 1/1935 Leonard ..... 33/648
2,870,627 A * 1/1959 Garth ..... 52/749.13
4,939,846 A * 7/1990 Damiano et al. ..... 33/404
6,662,516 B2 12/2003 Vandehey et al.
6,857,234 B2 * 2/2005 Goudreau et al. ..... 52/243
2012/0096806 A1 * 4/2012 Fransen ..... 52/749.14

OTHER PUBLICATIONS

SR Contractors LLC, "Veneer Attachment," 1 p. (Feb. 17, 2011).
Yana, Masonry Advisory Council, "Think Systems," downloaded from http://web.archive.org/web/20080510143552/http://www.maconline.org/tech/design/thinksystems/thinksystems.html, 3 pp. (document not dated, archive date May 10, 2008).
Yana, Masonry Advisory Council, "Think Systems," downloaded from http://web.archive.org/web/20080725090625/http:/www.maconline.org/tech/design/thinksystems/brick-wood_stud-wall/brick-wood_stud-wall.html, 3pp. (document not dated, archive date Jul. 25, 2008).
Yana, Masonry Advisory Council, "Think Systems," downloaded from http://web.archive.org/web/20060923000645/http:/www.maconline.org/tech/design/thinksystems/thinksystems.html, 8pp. (document not dated, archive date Sep. 23, 2006).

* cited by examiner

*Primary Examiner* — Jessica Laux
(74) *Attorney, Agent, or Firm* — Klarquist Sparkman, LLP

(57) ABSTRACT

Systems and methods for modifying existing walls are disclosed. In certain embodiments, a masonry wall is constructed near an existing wall, and the cavity between the two walls is filled with a foamable, adhesive material. The foamable, adhesive material adheres to both walls, creating an adhesive connection between them. Certain embodiments create multiple layers of the foamable, adhesive material, allowing each layer to expand before the next is introduced. Certain embodiments utilize a brush device to reduce the amount of mortar left between the two walls. Certain embodiments utilize clips for temporarily securing the masonry wall to the existing wall.

20 Claims, 6 Drawing Sheets

METHOD OF CONSTRUCTING A MASONRY WALL

CROSS REFERENCE TO RELATED APPLICATION

This application claims the benefit of U.S. Provisional Patent Application No. 61/545,970, filed Oct. 11, 2011, which is hereby incorporated by reference.

FIELD

The present disclosure concerns embodiments of a construction technique that can be used for modifying existing walls.

BACKGROUND

There are many structures in need of structural reinforcement or retrofitting to provide better insulation, waterproofing, a vapor barrier, and/or aesthetic properties. In some cases these are older structures whose designs or methods of construction are inadequate in light of present engineering standards and construction methods. In other cases these are new structures under construction that could benefit from the development of new methods of reinforcing and otherwise modifying existing designs. One method that has been used to accomplish some of these aims is building a masonry veneer that is structurally tied to an existing wall. In the past, these have been anchored to the existing wall using mechanical fasteners and required the provision of an open space behind the masonry veneer to allow penetrating moisture to drain and exit at weep holes. The provision of an open space and weep holes and the use of mechanical fasteners make the structure unnecessarily complex and increase its total cost.

Accordingly, it would be desirable to provide methods of building masonry veneers that do not require the provision of an open space or weep holes, and that can be completed without the use of mechanical fasteners for structurally tying the veneer to the existing wall. It would also be desirable to provide methods of constructing masonry veneers that have greater strength, insulation, waterproofing, vapor-proofing, and aesthetic properties, and to do so at a lower total cost.

SUMMARY

Disclosed herein are embodiments of an invention allowing the modification of existing walls. The disclosed methods can be applied to a wall of an old house or building or to a recently constructed existing wall of a house or building under construction. In certain embodiments, a masonry wall is constructed near an existing wall, and the cavity between the two walls is filled with a foamable, adhesive material. The foamable, adhesive material adheres to both walls, creating an adhesive connection between them. Certain embodiments create multiple layers of the foamable, adhesive material, allowing each layer to expand before the next is introduced. Certain embodiments utilize a brush device to reduce the amount of mortar left between the two walls. Certain embodiments utilize clips for temporarily securing the masonry wall to the existing wall while the adhesive material is introduced into the cavity.

In one embodiment, a plurality of vertically stacked courses of masonry units are formed a desired distance from an existing wall, creating a cavity between the masonry and the existing wall. The uppermost course of masonry units can be secured to the existing wall using removable clips, and the cavity can be filled with a foamable, adhesive material, which is allowed to cure. Thereafter, the clips can be removed.

In another embodiment, a brush can be positioned along the bottom of an existing wall and can be attached to a tether connected to a fixed location above the intended top of a masonry wall. A plurality of vertically stacked courses of masonry units are formed a desired distance from the existing wall, creating a cavity between the masonry and the existing wall, with the brush at the bottom of the cavity. The tether can be used to raise the brush, removing excess mortar from the cavity. The uppermost course of masonry units can be temporarily secured to the existing wall using removable clips and the cavity can be filled with a foamable, adhesive material, which is allowed to cure. Thereafter, the clips can be removed.

In yet another embodiment, a bottom portion of a masonry wall can be constructed a desired distance from an existing wall. The masonry wall can be temporarily secured to the existing wall using mechanical fasteners, and a foamable, adhesive material can be introduced between the masonry and the existing wall and allowed to cure. The mechanical fasteners can then be removed, and an additional portion of masonry wall can be constructed on top of the masonry wall already adhesively secured to the existing wall. The additional portion of the masonry wall can be temporarily secured to the existing wall using mechanical fasteners and the foamable, adhesive material can be introduced between the additional portion of the masonry wall and the existing wall and allowed to cure. Thereafter, the mechanical fasteners can be removed.

DETAILED DESCRIPTION

FIGS. 1-4 illustrate a method for constructing a first masonry wall (e.g., wall 10) adjacent a second wall (e.g., wall 12). The method involves the use of a foamable, adhesive material to secure the first wall to the second wall. The foamable, adhesive material also serves as a vapor barrier and a waterproofing layer for the wall structure, and insulates the structure. The method has particular applicability for constructing a veneer masonry wall 10 adjacent an existing wall 12. The existing wall 12 can be a wall of an old structure (e.g., house or building) being renovated, or a recently built wall of a new structure being built. As such, the disclosed methods can be used for constructing new wall structures or for retrofitting existing wall structures.

Figure 1:
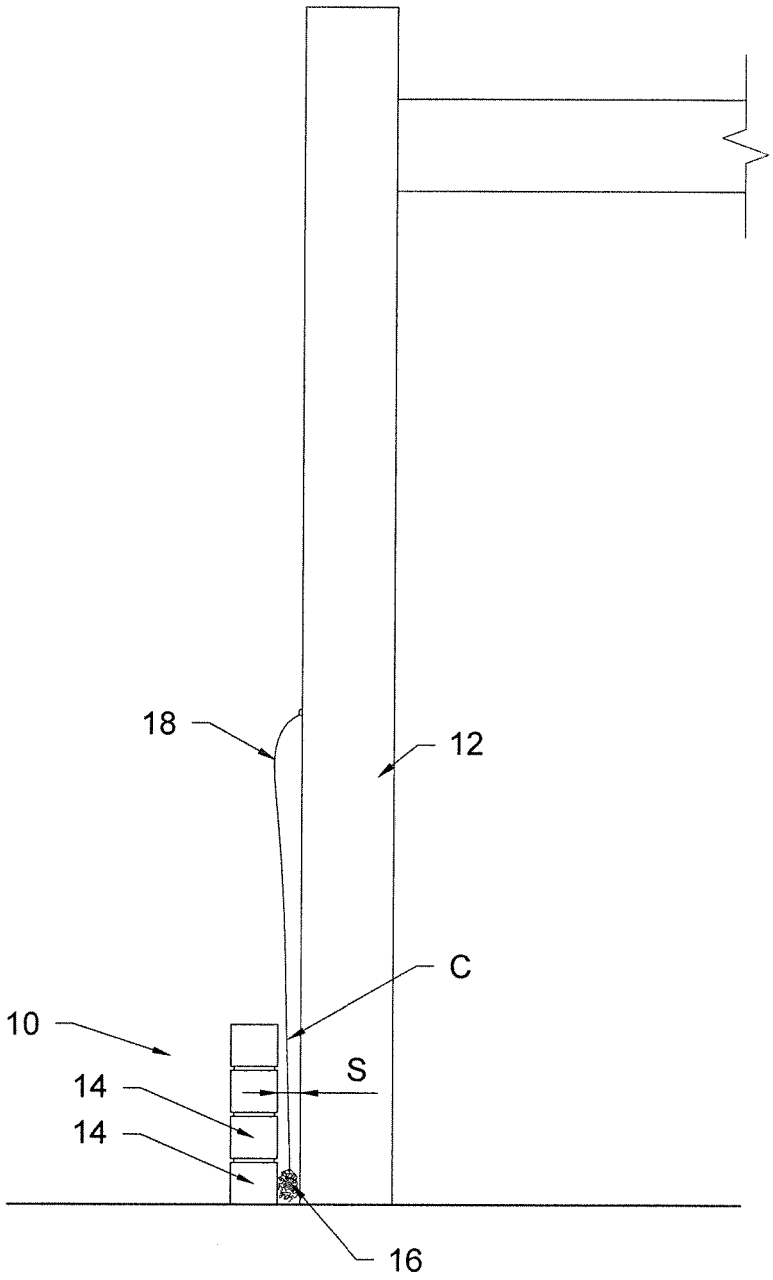
FIGS. 1-4 illustrate a construction technique for constructing a veneer masonry wall adjacent an existing wall.

Referring to FIG. 1, the masonry wall 10 is constructed relative to the existing wall 12 to create a cavity C having a spacing S equal to a desired distance between the two walls. In particular embodiments, the spacing S between the walls (the width of the cavity) is at least 2 inches and can be varied as needed depending upon the particular application. The masonry wall 10 itself can constructed by laying masonry units 14 (e.g., bricks, stones, or concrete blocks) in vertically stacked courses and using mortar or grout to form the joints between adjacent units 14, as known in the art. Each course of masonry units can comprise a plurality of masonry units placed end-to-end in a row. In other embodiments, each course of masonry units can be formed by placing the masonry units in various orientations, as known in the art.

As the wall 10 is constructed, a brush or gasket device 16 is placed at the very bottom of the cavity between the existing wall 12 and the first course of masonry units. The brush device 16 is connected to the lower end of a tether 18, which can be, for example, a length of wire, rope, or string. The upper end of the tether 18 is secured at a convenient position above the wall 10 under construction, such as at a location on the existing wall 12 adjacent the upper end of the wall 12. The brush device 16 desirably extends the length of the cavity between the two walls. The purpose of the brush device is to catch excess mortar that falls into the cavity as the mason forms the courses of the wall 10. Additionally, after a predetermined number of courses have been formed, using the tether 18, the mason can drag or pull the brush device 16 upwardly against the inner surface of the wall 10, causing the brush device to brush or otherwise scrape off mortar fins (excess mortar) that extends outwardly from the joints between the masonry units 14. The brush device collects the excess mortar and keeps the cavity substantially free of mortar fins and droppings, which can otherwise create flow paths for air or water once the adhesive material is introduced into the cavity.

In particular embodiments, the brush device 16 comprises a roll of fibrous material, such as felt, fiberglass netting, or polymeric fiber. The brush device 16 can comprise an internal stiffening member, such as a wooden 2×4, which is wrapped in the fibrous material. Desirably, the width of the brush device is slightly less than the width of the cavity C. As noted above, the brush device 16 desirably extends the entire length of the cavity to prevent any excess mortar from accumulating in the cavity. If the cavity is relatively long, a plurality of tethers 18 can be used to support the brush device. Each tether 18 can be spaced apart from each other along the length of the cavity C and can have a lower end secured to the brush device 16 and an upper end secured at a respective fixed location above the intended top of the masonry wall 10. In an alternative embodiment, a plurality of brush devices 16 can be placed end-to-end along the length of the cavity, in which case each brush device can be supported by one or more respective tethers 18. The brush device 16 eliminates the need for providing clean outs, or access openings, at the bottom of the wall to remove excess mortar. By removing mortar fins, the brush device allows for a better insulated cavity.

Figure 2:
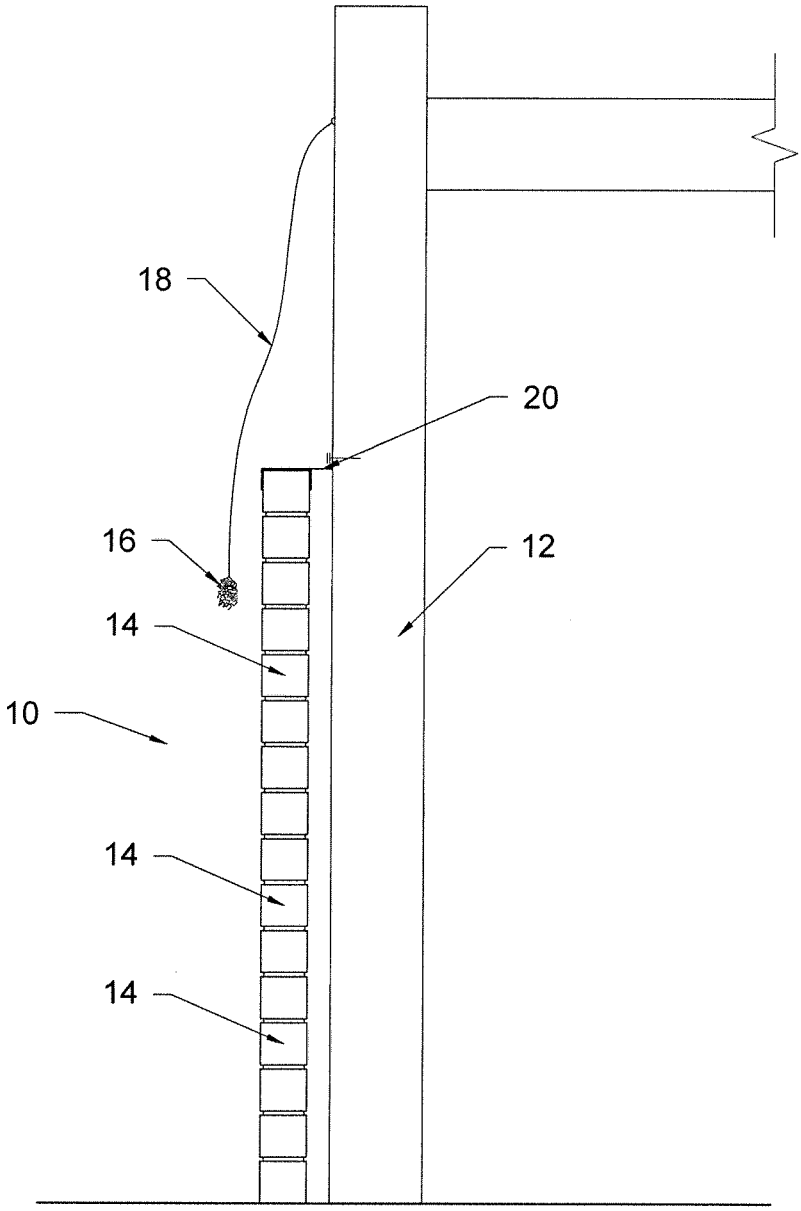

Referring to FIG. 2, after the predetermined number of courses have been formed, the uppermost course can be secured to the existing wall 12 using one or more fasteners, such as the illustrated clips 20. Although only one clip 20 is shown in the drawings, a plurality of clips can be spaced along the length of the uppermost course. In particular embodiments, the clips 20 are temporary in that they are removed (and desirably can be re-used) just prior to forming the next course of masonry units 14. The clips 20 hold the partially constructed wall 10 in place relative to the existing wall 12 as the foamable, adhesive material is introduced into the cavity, as further described below. FIG. 2 also shows the brush device outside of the cavity after it has been used to scrape off the mortar fins on the inner surface of the partially constructed wall 10. Typically, it is desirable to remove the brush device from the cavity before the clips 20 are installed. In a specific implementation, the wall is constructed to a height of about 6 feet to about 10 feet, with about 8 feet being a specific example, before the clips are installed.

Figure 3:
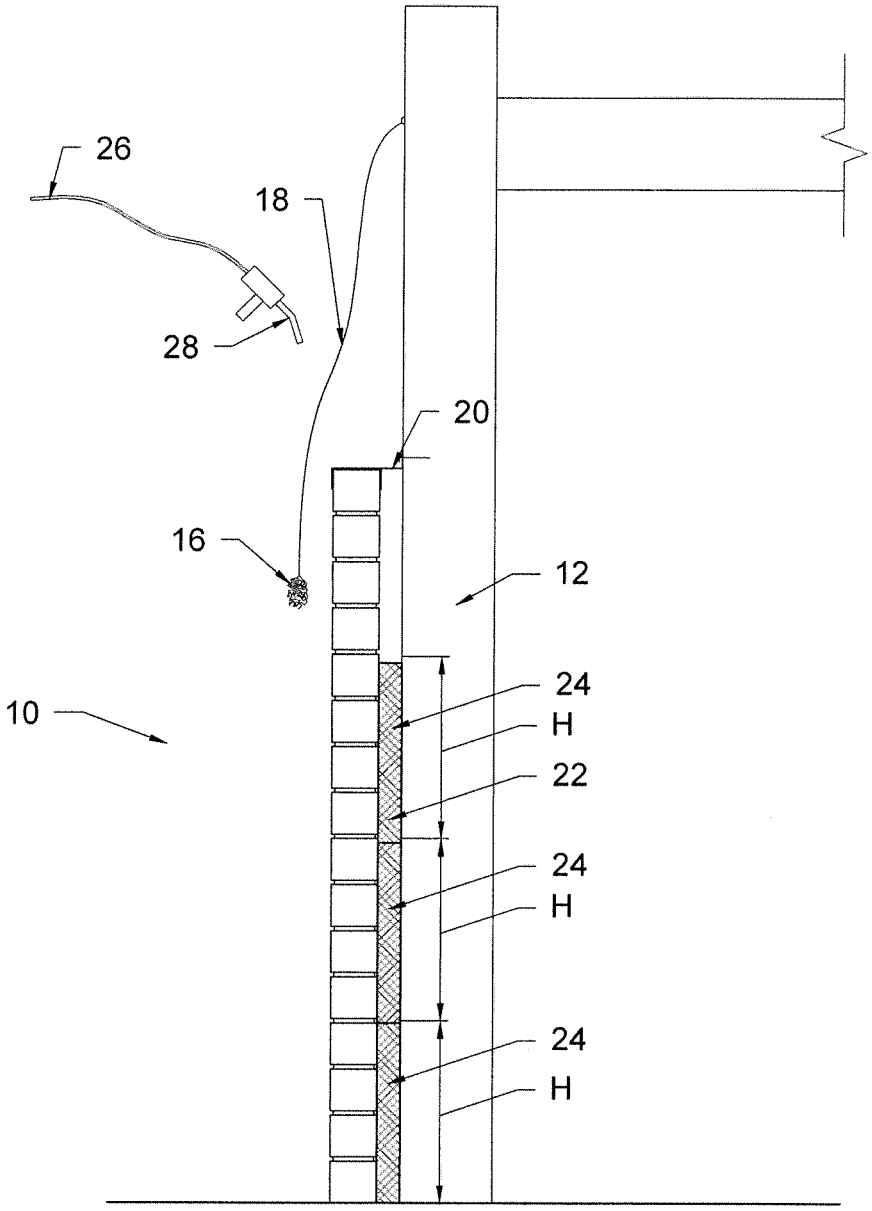

Referring to FIG. 3, after installation of the clips 20, the cavity can be filled with a foamable, adhesive material 22 to bond the partially constructed wall 10 to the existing wall 12. In particular embodiments, the cavity is filled with a plurality of layers 24 of the foamable, adhesive material 22. Desirably, the adhesive material 22 has the following characteristics: high adhesion to provide a strong bond between the walls; high compressive, tensile, and shear strength; and low expansion. The adhesive material 22 desirably is sufficiently elastic to adsorb energy transmitted to the wall structure caused by seismic activity, has a minimal set up or cure time, and produces minimal off gases harmful to those handling the adhesive material. The adhesive material 22 also may be selected to provide waterproofing for the wall structure to which the adhesive material is applied. Some examples of adhesive material that can be used include, without limitation, open or closed cell polyurethane foam, or other suitable materials. Closed cell foams are most desirable in that they are substantially impervious to water. A suitable polyurethane foam is SR Foam, a closed cell polyurethane foam available from SR Contractors (Portland, Oreg.). The adhesive material 22 desirably has a density from about 1 lb./ft.$^3$ to 10 lbs./ft.$^3$, and even more desirably from about 2 lbs./ft.$^3$ to 10 lbs./ft.$^3$.

The adhesive material can be formed by mixing a resin base material stored in a first container with a conventional activating agent stored in a second container. In one example, the base material and activating agent are mixed in a one-to-one ratio. To form polyurethane foam, such as described above, the base material would be a polyurethane resin. The base material may contain surfactants, fire retardants, a blowing agent and other additives. The density of the adhesive material 22 introduced into the cavity can be varied by starting with a base material of a different formulation, typically by varying the amount of activating agent in the formulation.

Pumps (not shown) in the first and second containers pump the resin base material and activating agent, respectively, through respective hoses (not shown) into a proportioning unit (not shown). The proportioning unit pumps the base material and the activating agent at about 1000 psi through respective hoses 26 to a spray gun, or nozzle, 28 wherein the base material is mixed with the activating agent. The proportioning unit and the hoses desirably have heating coils to preheat the base material and activating agent to about 120 degrees F. When the materials mix in the spray gun 28, the activating agent triggers an exothermic chemical reaction, the product of which is the adhesive foam material 22 typically having an initial temperature of about 140 degrees F. During this early exothermic stage, the foam is in a viscous seam-like state and can be poured into the cavity. Once in the cavity the foam flows and expands to fill the cavity.

The nozzle 28 is moved longitudinally along the bottom of the cavity to form an even layer 24 of material of a height H. After the adhesive material is sprayed into the cavity to form the bottommost layer 24, the end of the nozzle 28 is raised a sufficient distance so as to avoid contact with the expanding adhesive material, which is allowed to cure before another layer of adhesive material is formed on the bottommost layer 24. Preferably, the adhesive material is cured until it expands at only a minimal rate (e.g., the adhesive material has expanded to about 99 percent of its expanded state), or more even preferably, to a point where the adhesive material no longer expands. The cure time is a function of the foam density and temperature of the foam. For example, the cure time for a foam density of 2 lbs./ft.$^3$ is about 4 minutes while the cure time for a foam density of 10 lbs./ft.$^3$ may be longer. Also, curing time increases as the temperature of the foam decreases. Once the adhesive material has substantially cured, the end of the nozzle 28 is positioned at a point just above the previously formed, bottommost layer 24 and adhesive material is sprayed on top of the bottommost layer as the nozzle is moved longitudinally of the cavity so as to form an additional layer of adhesive material. The layering process is then repeated until the cavity is filled with layers having substantially the same height H (as illustrated in FIG. 3). In particular embodiments, the height H of each layer 24 is about 6 inches to about 48 inches, with about 16 inches being a specific example. Additional details regarding the foamable material 22 and the technique for forming successive layers in the cavity are provided in U.S. Pat. No. 6,662,516, which is incorporated herein by reference.

Figure 4:
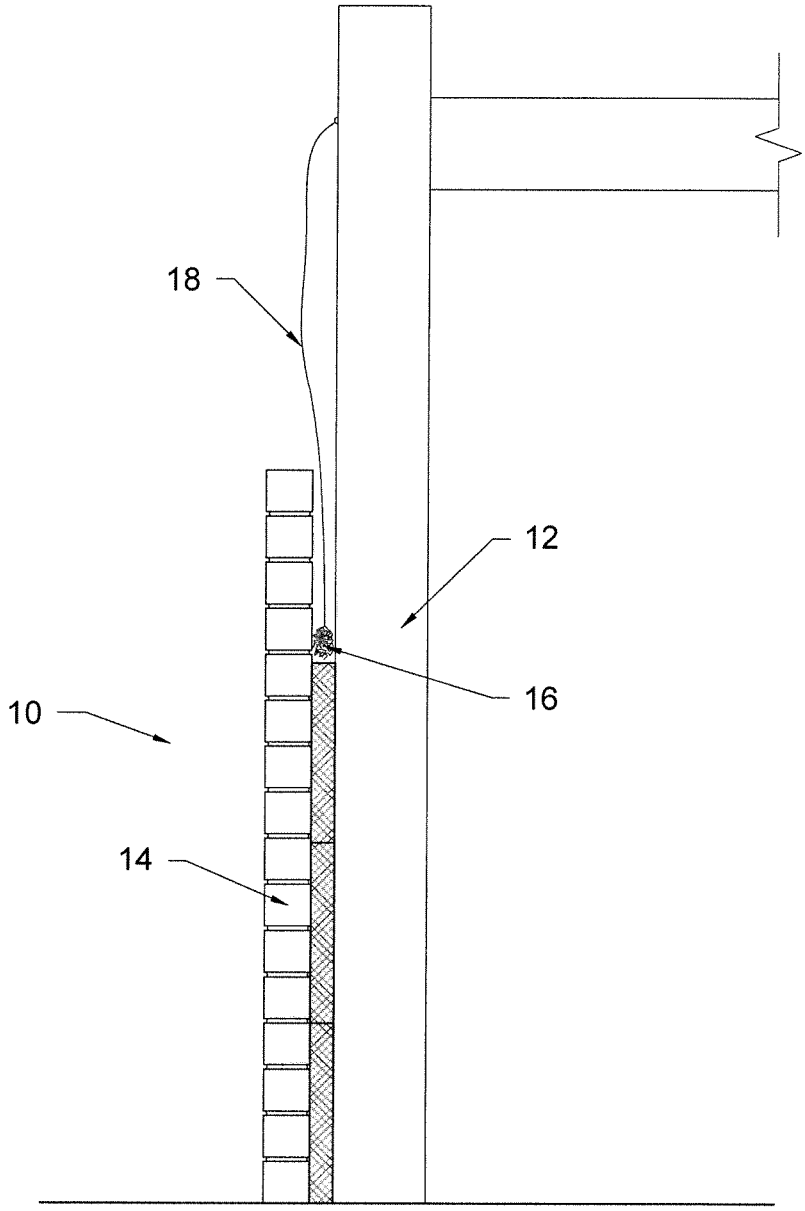

As shown in FIG. 4, a small section of the cavity adjacent the upper portion of the partially constructed wall 10 can be left empty (without any material 22). After forming the uppermost layer 24 of material 22, the clips 20 can be removed from the wall and the brush device 16 can be reinserted into the cavity so as to rest on top of the uppermost layer of material 22. The clips 20 desirably are configured to be reusable. Thereafter, additional courses of masonry units 14 can be formed to a predetermined height, the top of the partially constructed wall can be secured to the existing wall with clips 20, and the cavity can be filled with layers of materials 22, as previously described. This process can be repeated as needed until the wall 10 is fully formed.

As noted above, the material 22 bonds the masonry wall 10 to the existing wall 12, thereby eliminating the need for conventional ties for securing the masonry wall to the existing wall. The layers of material 22 also function as a water and air barrier for the wall structure such that traditional wall waterproofing is not required. Additionally, conventional weep holes in the masonry wall are not required. Furthermore, the layers of material 22 also insulate the building.

Figure 6:
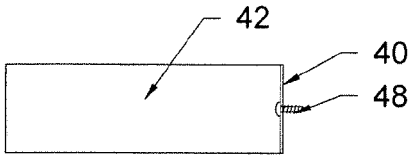
FIG. 6 is a top plan view of the clip shown in FIG. 5.
Figure 7:
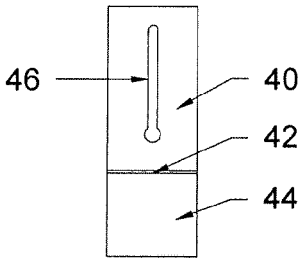
FIG. 7 is a front elevation view of the clip shown in FIG. 5.
Figure 5:
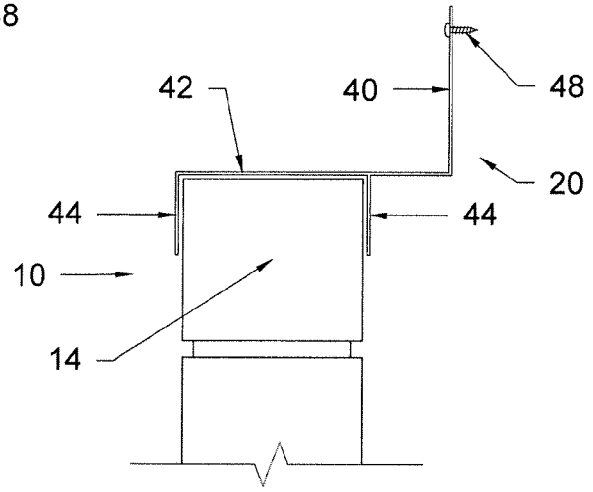
FIG. 5 is an enlarged side elevation view of one embodiment of a wall clip shown mounted on the uppermost course of a partially constructed masonry wall.
Figure 10:
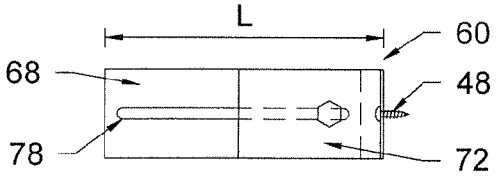
FIG. 10 is a top plan view of the clip shown in FIG. 8.
Figure 9:
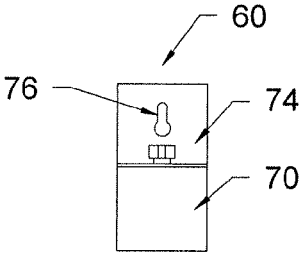
FIG. 9 is a front elevation view of the clip shown in FIG. 8.
Figure 8:
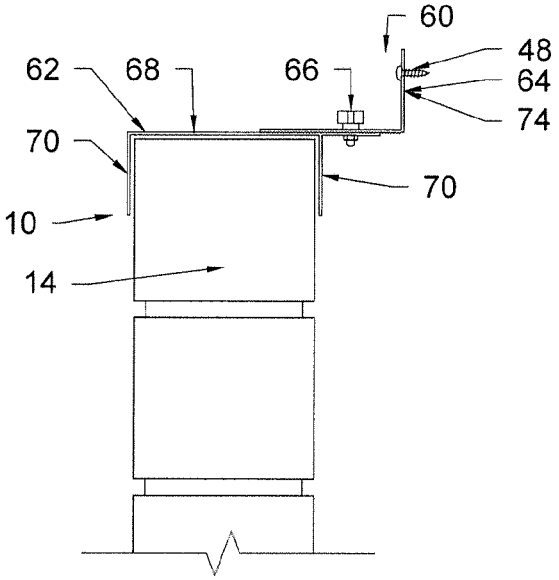
FIG. 8 is an enlarged side elevation view of another embodiment of a wall clip shown mounted on the uppermost course of a partially constructed masonry wall.

FIG. 5 is an enlarged view of a clip 20 shown mounted on the uppermost course of a partially constructed wall 10. FIGS. 6 and 7 are top plan and elevation views, respectively, of the clip. The clip 20 in the illustrated embodiment comprises a vertical portion 40, a horizontal portion 42, and two leg portions 44 extending downwardly from the horizontal portion 42. The lateral spacing between the leg portions 44 is selected to be equal to or slightly greater than the width of masonry units 14 so that the clip can be easily placed over a masonry unit and firmly engage the rear and front faces of the masonry unit. As shown in FIG. 7, the vertical portion 40 can be formed with a vertical slot 46 that receives one or more screws 48 that can be tightened into the existing wall 12.

FIGS. 8-11 illustrate an adjustable clip 60 that can be used in the construction of the wall 10. The clip 60 is configured to be adjustable in length to accommodate different cavity widths. The clip 60 in the illustrated embodiment includes a first wall engaging component 62 coupled to a second wall engaging component 64 by a clamping device 66. The first wall engaging component 62 comprises a horizontal portion 68 and two leg portions 70 that engage the front and rear faces of a masonry unit 14. The second wall engaging component 64 comprises a horizontal portion 72 and a vertical portion 74, which is formed with a slot 76 for receiving one or more screws 48 that are screwed into the existing wall 12. The horizontal portion 68 of the first wall engaging component can be formed with a slot 78 that receives a shaft 80 of the clamping device 66.

Figure 11:
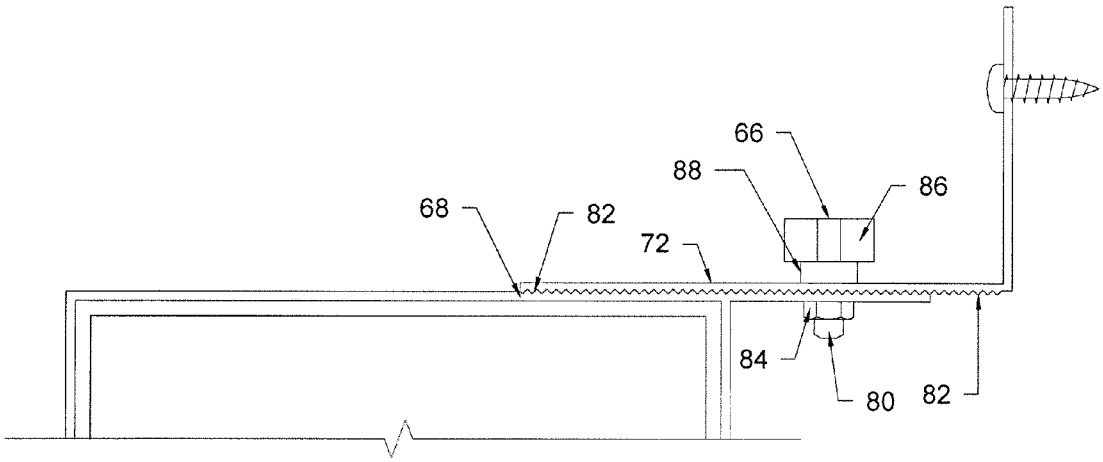
FIG. 11 is an enlarged view of a portion of the clip shown in FIG. 8.

The clamping device 66 is configured to tightly clamp and release the respective horizontal portions 68, 72 of the first and second wall engaging components to permit adjustment of the overall length L of the clip. When the clamping device 66 is loosened, the first and second wall engaging components can be moved relative to each other to adjust the overall length L of the clip to accommodate the width of the cavity being formed. When the clamping device is tightened, the respective horizontal portions 68, 72 of the first and second wall engaging components are tightly secured to each other. In this state, the overall length L of the clip 60 is fixed and the clip is effective to retain the partially constructed wall in place as the foamable material is introduced into the cavity. As best shown in FIG. 11, the contacting faces of the horizontal portions 68, 72 can be formed with teeth 82 (or similar surface features) that intermesh with each other and prevent slippage between the first and second wall engaging components.

As best shown in FIG. 11, the clamping device 66 can include a fixed nut 84 that is fixedly secured (e.g., welded) to the lower end portion of the shaft 80 and a rotatable knob 86 received on the upper portion of the shaft 80 (the knob can have internal threads that engage external threads of the shaft). An o-ring or washer 88 can be disposed on the shaft 80 between the knob 86 and the fixed nut 84. Rotating the knob 86 in a first direction (e.g., clockwise) is effective to secure the wall engaging components to each other while rotating the knob 86 in the opposite direction (e.g., counterclockwise) is effective to loosen the clamping device and allow for adjustment of the clip's length.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A method for constructing a masonry wall adjacent an existing wall, comprising:

forming a plurality of vertically stacked courses of masonry units a desired distance from the existing wall, thereby creating a cavity between the masonry units and the existing wall;

temporarily securing the uppermost course of masonry units to the existing wall using removable clips;

filling the cavity between the masonry units and the existing wall with a foamable, adhesive material, and allowing the foamable, adhesive material to cure, thereby adhesively securing the masonry units to the existing wall; and removing the removable clips from the uppermost course of masonry units.

2. The method of claim 1, further comprising:

forming additional courses of masonry units on top of the existing courses of masonry units, thereby creating a cavity between the additional courses of masonry units and the existing wall;

temporarily securing the uppermost course of masonry units to the existing wall using removable clips;

filling the cavity between the additional courses of masonry units and the existing wall with the foamable, adhesive material, and allowing the foamable, adhesive material to cure, thereby adhesively securing the masonry units to the existing wall; and removing the removable clips from the uppermost course of masonry units.

3. The method of claim 1, wherein the masonry units comprise a material selected from the group consisting of: bricks, stones, and concrete.

4. The method of claim 1, wherein the desired distance is at least two inches.

5. The method of claim 1, further comprising:

prior to forming the plurality of vertically stacked courses of masonry units:

positioning a brush along the bottom of the existing wall; and attaching one end of a tether to a fixed location above the intended top of the masonry wall, the other end of the tether being attached to the brush; and after forming the plurality of vertically stacked courses of masonry units but before temporarily securing the uppermost course of masonry units to the existing wall, using the tether to raise the brush from the bottom of the cavity, thereby removing any mortar fins formed in the cavity and any excess mortar that fell into the cavity during the forming of the courses of masonry units.

6. The method of claim 1, wherein the foamable, adhesive material comprises an open cell or a closed cell polyurethane foam.

7. The method of claim 1, wherein filling the cavity comprises:

forming a first layer of the foamable, adhesive material along the bottom of the cavity;

allowing the first layer of the foamable, adhesive material to expand; and forming at least a second layer of the foamable, adhesive material along the top of the first layer of the foamable, adhesive material, after the expansion of the first layer.

8. The method of claim 1, wherein after the clips are removed, the masonry wall is secured to the existing wall only by the adhesive material.

9. The method of claim 1, wherein the removable clips each comprise an upper portion and a lower portion and the step of temporarily securing the uppermost course of masonry units comprises placing the lower portion on the uppermost course of masonry units and temporarily securing the upper portion to the existing wall with a fastener.

10. The method of claim 9, wherein the upper portion of each removable clip comprises a first vertical portion having a slotted opening for receiving the fastener and the lower portion of each removable clip comprises:

a horizontal portion connected to the first vertical portion; and a second vertical portion and a third vertical portion each connected to the horizontal portion and spaced apart from each other a distance approximating the width of a course of masonry units such that the second and third vertical portions can be placed on opposing sides of the uppermost course of masonry units.

11. The method of claim 10, wherein the removable clips are adjustable such that a length of the lower portion may be increased or decreased and the step of temporarily securing the uppermost course of masonry units further comprises adjusting the length of the lower portion to accommodate the width of the cavity.

12. The method of claim 11, wherein the lower portion comprises two overlapping portions, the first portion having a hole and the second portion having a slot, wherein a bolt extends through the hole and the slot and a nut is disposed on the bolt, and adjusting the length of the lower portion comprises loosening the nut, sliding the second portion with respect to the first portion, and tightening the nut on the bolt.

13. A method for constructing a masonry wall adjacent an existing wall, comprising:

positioning a brush along the bottom of the existing wall;

attaching one end of a tether to a fixed location above the intended top of the masonry wall, the other end of the tether being attached to the brush;

forming a plurality of vertically stacked courses of masonry units a desired distance from the existing wall, thereby creating a cavity between the masonry units and the existing wall, with the brush at the bottom of the cavity;

using the tether to raise the brush from the bottom of the cavity, thereby removing any mortar fins formed in the cavity and any excess mortar that fell into the cavity during the forming of the courses of masonry units;

temporarily securing the uppermost course of masonry units to the existing wall using removable clips;

filling the cavity between the masonry units and the existing wall with a foamable, adhesive material, and allowing the foamable, adhesive material to cure, thereby adhesively securing the masonry units to the existing wall; and removing the removable clips from the uppermost course of masonry units.

14. The method of claim 13, further comprising:

positioning the brush along the existing wall on top of the cured foamable, adhesive material;

forming additional courses of masonry units on top of the existing courses of masonry units, thereby creating a cavity between the additional courses of masonry units and the existing wall, with the brush at the bottom of this cavity;

using the tether to raise the brush, thereby removing any mortar fins formed in the cavity and any excess mortar that fell into the cavity during the forming of the additional courses of masonry units;

temporarily securing the uppermost course of masonry units to the existing wall using removable clips;

filling the cavity between the additional courses of masonry units and the existing wall with the foamable, adhesive material, and allowing the foamable, adhesive material to cure, thereby adhesively securing the masonry units to the existing wall; and removing the removable clips from the uppermost course of masonry units.

15. The method of claim 13, wherein the brush comprises a roll of fibrous material.

16. The method of claim 13, wherein the brush comprises an internal stiffening member wrapped with a fibrous material.

17. The method of claim 13, wherein a plurality of tethers are attached to the brush and to respective fixed locations above the intended top of the masonry wall.

18. The method of claim 13, wherein a plurality of brushes are placed end-to-end along the length of the bottom of the existing wall.

19. A method for modifying an existing wall comprising:

constructing a bottom portion of a masonry wall a desired distance from the existing wall;

temporarily securing the masonry wall to the existing wall using mechanical fasteners;

introducing a foamable, adhesive material between the masonry wall and the existing wall;

allowing the foamable, adhesive material to cure, thereby adhesively securing the masonry wall to the existing wall;

removing the mechanical fasteners;

constructing an additional portion of masonry wall on top of the masonry wall adhesively secured to the existing wall;

temporarily securing the additional portion of masonry wall to the existing wall using mechanical fasteners;

introducing a foamable, adhesive material between the additional portion of masonry wall and the existing wall;

allowing the foamable, adhesive material to cure, thereby adhesively securing the additional portion of masonry wall to the existing wall; and removing the mechanical fasteners.

20. The method of claim 19, further comprising:

prior to constructing the bottom portion of the masonry wall:

positioning a brush along the bottom of the existing wall; and attaching one end of a tether to a fixed location above the intended top of the masonry wall, the other end of the tether being attached to the brush; and after constructing the bottom portion of the masonry wall but before temporarily securing the masonry wall to the existing wall, using the tether to raise the brush, thereby removing any mortar fins formed and any excess mortar that fell between the masonry wall and the existing wall during construction of the masonry wall.

* * * * *